United States Patent [19]

Frederick

[11] 4,040,492

[45] Aug. 9, 1977

[54] MODULAR LEADS FRAME WITH NOISE ABATEMENT SYSTEM AND PILE FEEDER

[76] Inventor: Leonard L. Frederick, 15 Crestview Terrace, Whippany, N.J. 07981

[21] Appl. No.: 517,153

[22] Filed: Oct. 23, 1974

Related U.S. Application Data

[60] Division of Ser. No. 359,782, May 14, 1973, Pat. No. 3,887,017, which is a continuation-in-part of Ser. No. 142,173, May 11, 1971, Pat. No. 3,747,689.

[51] Int. Cl.[2] ..... E02D 7/06

[52] U.S. Cl. ..... 173/1; 173/DIG. 2

[58] Field of Search ..... 173/1, DIG. 2; 61/53.5; 181/33 K, 36 R, 36 A

[56] References Cited

U.S. PATENT DOCUMENTS

| | | | |
|---|---|---|---|
| 2,136,315 | 11/1938 | Pettit | 173/DIG. 2 |
| 3,750,765 | 8/1973 | Shelbourne et al. | 173/DIG. 2 |

FOREIGN PATENT DOCUMENTS

| | | | |
|---|---|---|---|
| 1,930,079 | 12/1970 | Germany | 173/DIG. 2 |

*Primary Examiner*—Ernest R. Purser
*Assistant Examiner*—William F. Pate, III
*Attorney, Agent, or Firm*—Edwin E. Greigg

[57] ABSTRACT

A modular leads frame for a pile driving machine is provided with a plurality of noise abating shield members which surround the driving hammer of the pile driving machine with certain ones thereof being moved with the driving hammer throughout its driving stroke in order to abate the noise resulting from the driving impact of the hammer against the pile.

The pile is fed into position by first hoisting the movable shield members and the driving hammer to the top of the leads frame, hoisting the pile to be driven into a vertical position after attaching the pile hoist line to one end of the pile at ground level and thereafter actuating a pile feeder which positions the vertically hoisted pile within the leads frame and in alignment with the driving hammer.

2 Claims, 11 Drawing Figures

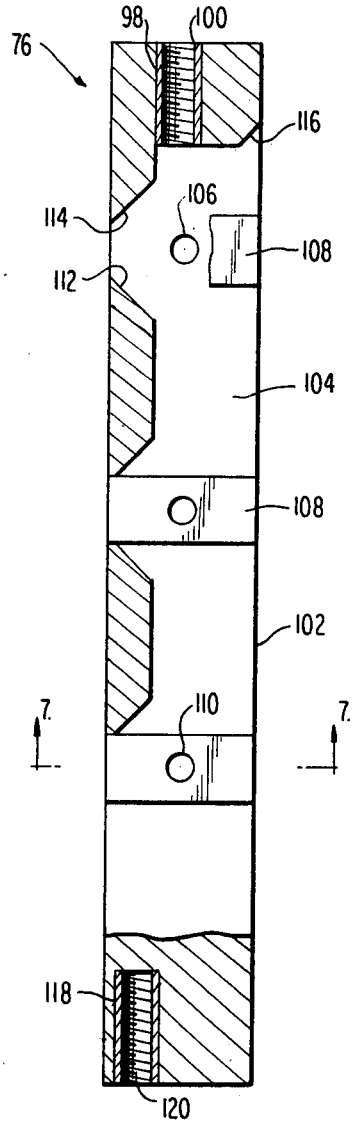
FIG. 6
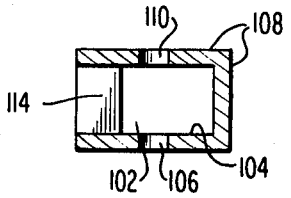
FIG. 7
FIG. 11
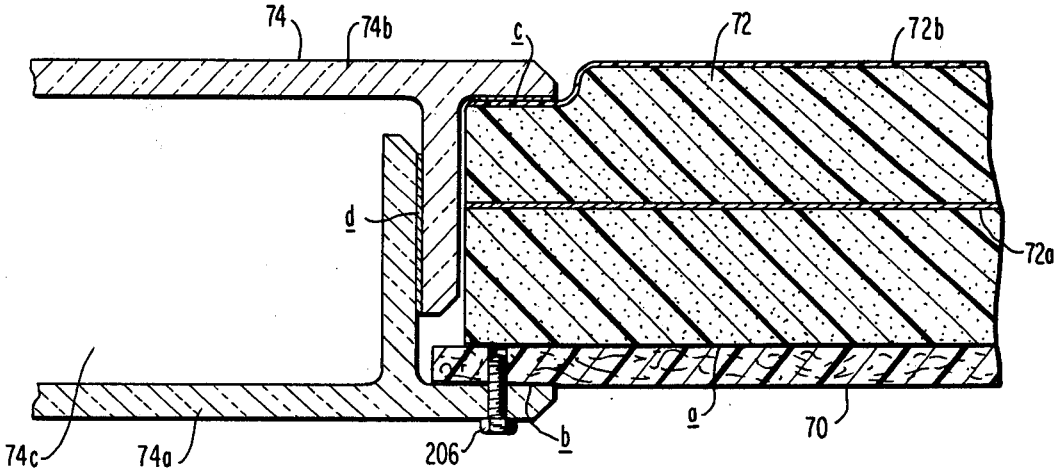

MODULAR LEADS FRAME WITH NOISE ABATEMENT SYSTEM AND PILE FEEDER

CROSS REFERENCE TO RELATED APPLICATION

This is a division of application Ser. No. 359,782, filed May 14, 1973, now U.S. Pat. No. 3,887,017 which is in turn a continuation in part of applicant's application Ser. No. 142,173, entitled "Modular Leads" and filed on May 11, 1971 now U.S. Pat. No. 3,747,689.

BACKGROUND OF THE INVENTION

In today's pollution-conscious society, noise pollution is receiving ever-increasing attention. In heavily populated areas, for example, the noise level deriving from vehicular traffic alone is reaching staggering proportions. To this can be added the effects of industrial noise and the noise which inevitably accompanies the construction activities to be found in every metropolitan area. The problem has become so acute that the U.S. Government has established a special agency (The Environmental Protection Agency) to deal with it.

Of particular concern for purposes of the present invention is the noise pollution which the construction industry generates, and, in particular, the noise pollution associated with heavy equipment, such as pile drivers. The present invention, therefore, deals with noise abatement, and, in particular, with noise abatement in heavy equipment, such as pile drivers.

Sound distribution studies on pile drivers have shown that the greatest intensity of noise is developed in the area where the hammer ram strikes the anvil or drive cap. From this point of impact the noise travels diminishingly down the pile that is being struck and to a lesser extent up the body or cylinder of the hammer and then to the leads frame. In addition, the noise propagates at the same time through the air in all directions. It would be desirable, therefore, to have a way of effectively abating the noise developed as a result of operating a machine such as a pile driver.

An added problem with which the construction industry has had to contend with is that of pile hoisting. At the present time it is necessary to employ a so-called "loft man" whose job is to ascend approximately midway to the top of the pile, just under the hammer. This is the dangerous part, because the hammer falls too fast when the pile is resting on soft ground, for example. Thus the hammer can crush the man. The loft man is necessary in order to correctly align the pile to be driven with respect to the drive hammer. This type of manual operation is time-consuming, fatiguing, and, as indicated above, quite dangerous. It would be desirable, therefore, to have a way of effectively eliminating the need for a loft man.

OBJECTS, SUMMARY AND ADVANTAGES OF THE INVENTION

It is, therefore, a general object of the present invention to provide a method and structure for noise abatement particularly for equipment utilized in the construction industry.

It is a more specific object of the present invention to provide a method and structure for abatement of the noise emanating from the impact of a hammer against a pile in a pile driving machine.

It is an even more specific object of the present invention to provide a shield system for abating the noise emanating from the impact of a hammer against a pile of a pile driving machine.

It is a related object of the present invention to abate the noise emanating from the impact of a hammer against a pile in a pile driving machine throughout the working stroke of the hammer.

It is a more specific related object of the present invention to provide a shield system for abating the noise emanating from the impact of a hammer against a pile of a pile driving machine which is displaceable along with the hammer throughout its stroke.

It is another related object of the present invention to provide a method and structure of feeding a pile into position in a pile driving machine.

It is yet another object of the present invention to effect the last-named object so that the pile is automatically aligned with the drive hammer of the pile driving machine.

It is yet another related object of the present invention to provide a noise abatement shield member for use where noise abatement in an observable environment is desired.

These and other objects are achieved according to the present invention by the provision of a plurality of noise abating shield members which are mounted to the leads frame of the pile driving machine so that noise abatement is achieved throughout the stroke of the pile driving hammer. The shield members include means for observing the environment being shielded.

In a related manner the pile which is fed by the pile driving machine is aligned with its driving hammer by feeder means associated with the pile driving machine.

As a result of the present invention, an effective and economical means for controlling noise pollution emanating from construction equipment, such as pile drivers and the like, is now available. Abatement of the noise pollution is accomplished by adding structure to the known leads frames including the modular leads frame of applicant's parent copending application. It is not necessary to eliminate any of the existing structure or to interfere with the operation of any of the existing structure.

The noise abating structure itself is preferably fabricated in the form of individual shield members or panels which are readily mounted to the leads frame with one side of the leads frame being provided with displaceable shield members. With this arrangement, positioning of the pile to be driven is facilitated. In conjunction with the positioning of the pile to be driven, the present invention also provides a pile feeder which aligns the pile with the driving hammer. The pile feeder feature of the present invention eliminates the need for a loft man. According to the present invention it is only necessary to attach the pile hoist line to one end of the pile at ground level.

Each of the shield members is preferably provided with a window for purposes of light transmission and observation into the leads frame. Visual inspection is therefore possible without the need for removing the mounted shield members.

The foregoing are but an exemplary sample of the many advantages to be derived from the present invention. Those skilled in the art will surely envision additional advantages within the contemplation of the present invention when considering the detailed description that follows.

Although the present invention will be described with reference to pile drivers, it should be understood that the present invention is adaptable to other equipment and other and different fields of application. For example, certain of the points of novelty set forth herein could find application wherever the noise source is susceptible to shielding.

BRIEF DESCRIPTION OF THE DRAWINGS

FIG. 6 is a partial cross-sectional view illustrating the terminal ends on one side of the inner front and rear shield members.

FIG. 7 is a cross-sectional view taken along the line 7—7 of FIG. 6.

FIG. 11 is a partial cross-sectional view illustrating in more detail a window assembly according to the present invention.

DESCRIPTION OF THE PREFERRED EMBODIMENTS

Figure 1:
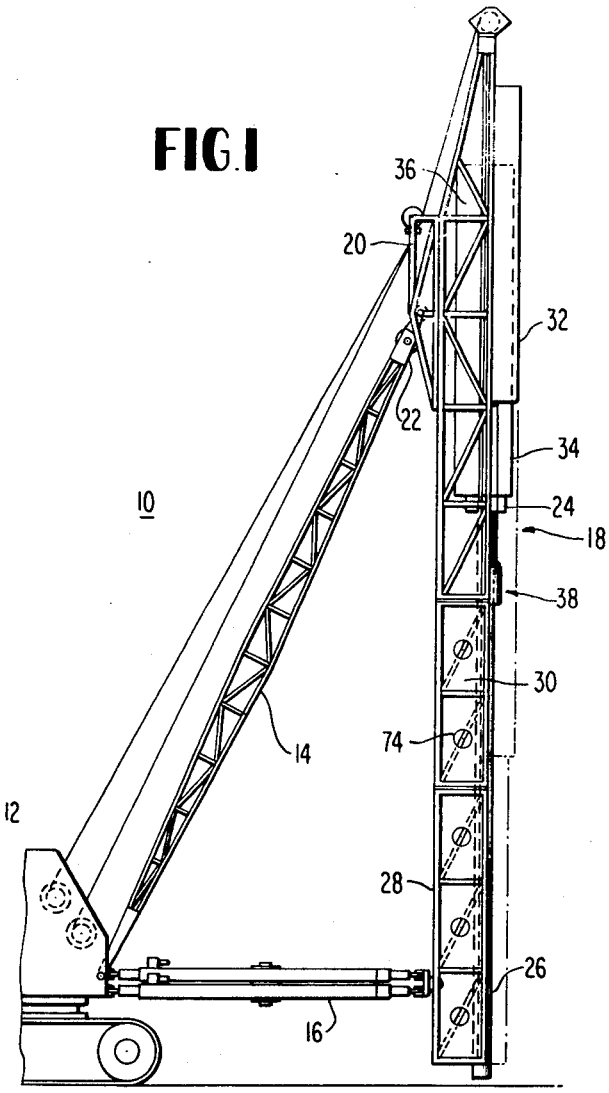
FIG. 1 is a side elevational view illustrating one end of a boom and of an X-frame attached to the front portion of a pile driving machine with the other end of the boom and the X-frame secured to the top and bottom, respectively, of a leads frame which is provided with the noise abating structure according to the present invention.

Referring now more specifically to the drawings, FIG. 1 illustrates a typical pile driving machine 10 which embodies the present invention. The pile driving machine 10 includes in its essential aspects a crane 12, a boom 14, an extensible X-frame 16 and a leads frame assembly 18. One end of both the boom 14 and the X-frame 16 is connected to the crane 12, while the other end of these elements is connected to the leads frame assembly 18. In this regard the front end of the boom 14 is pivotally connected to an auxiliary sheave 20 of the leads frame assembly 18 by boom tip adapters 22. The boom 14, the X-frame 16 and the leads frame assembly 18 cooperate in a well-known manner. For example, attention is directed to applicant's copending application Ser. No. 142,182, entitled "Bottom Brace for Hammer Leads Frame" and filed on May 11, 1971.

The source of the noise pollution is, of course, the impact of the driving hammer 24 against the pile 26. By the present invention a method and structure for abating the noise resulting from the impact of the driving hammer 24 against the pile 26 is set forth which effectively abates the impact noise throughout the working stroke of the driving hammer 24 along the leads frame assembly 18, without encumbering the leads frame assembly 18 insofar as mounting the leads frame assembly, making additions to the leads frame assembly or positioning a pile within the leads frame assembly to be driven is concerned.

Figure 2:
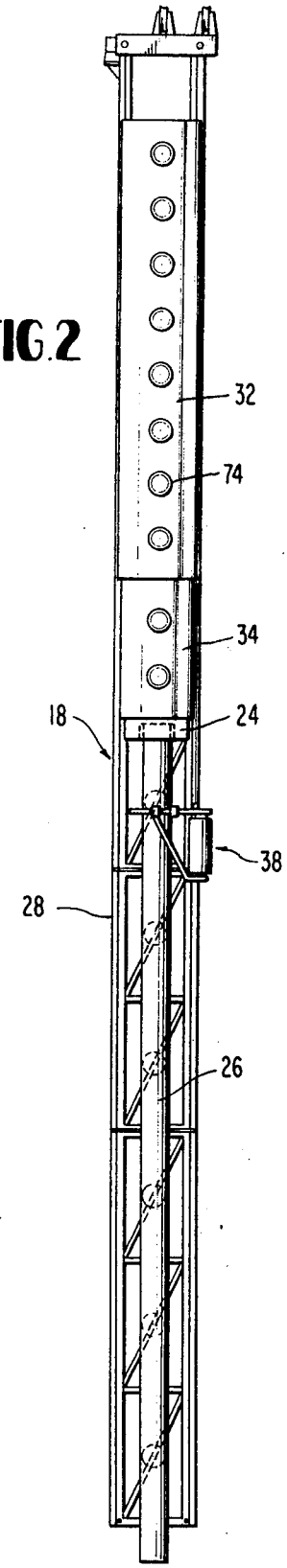
FIG. 2 is a front elevational view of the leads frame illustrating in further detail the overlapping displaceable shield members and the pile feeder means according to the present invention.
Figure 5:
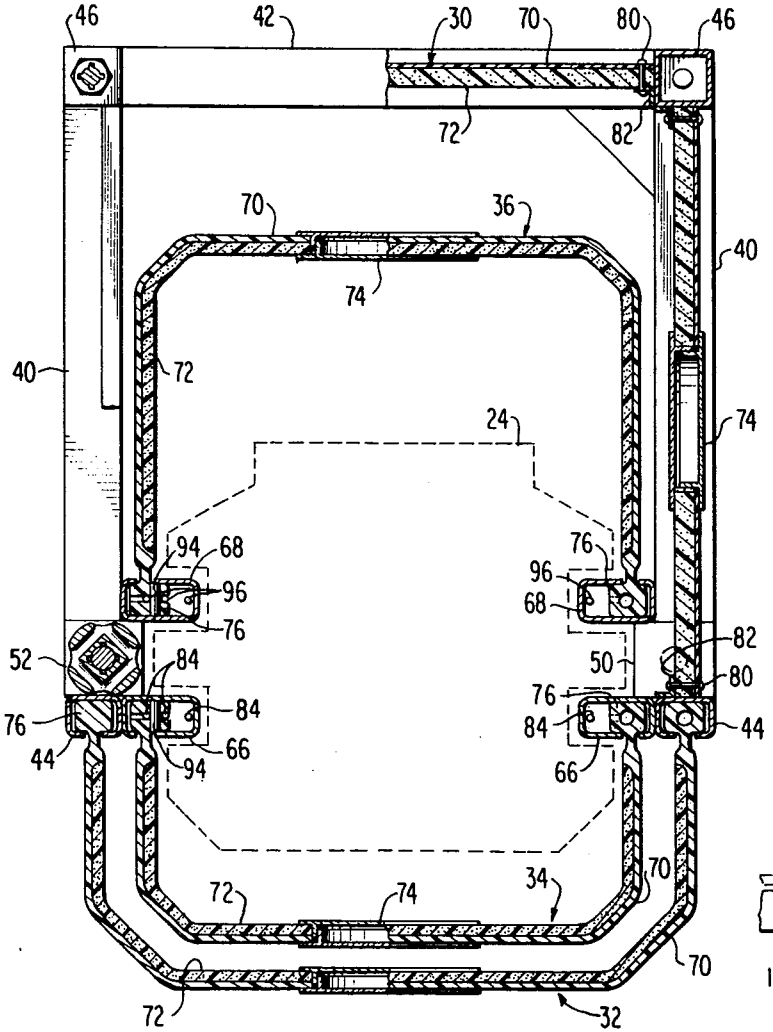
FIG. 5 is a cross-sectional view taken along the line 5—5 of FIG. 8.

Turning now to a more specific consideration of the structural aspects of the leads frame assembly 18 and the noise abating members, it is noted that the leads frame assembly 18 includes any desired number of individual modular sections 28 which are stacked end to end to form a longitudinal beam-type structure which in cross section has a generally C-shape, as most clearly shown in FIGS. 1, 2 and 5.

Figure 3:
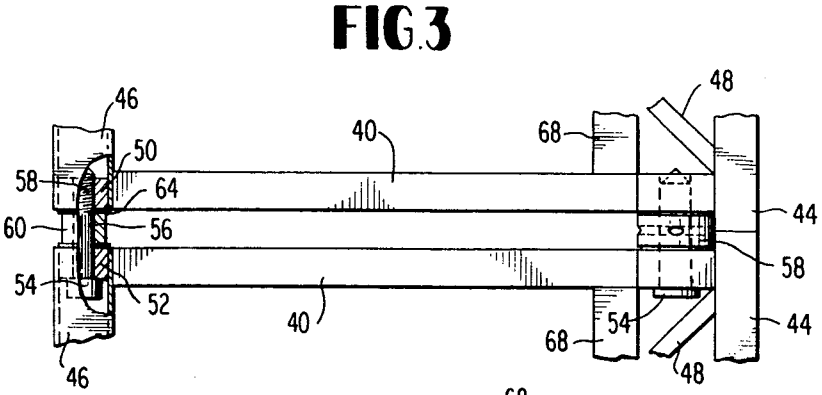
FIG. 3 is a partial cross-sectional view illustrating the connection between two successive modular sections of the modular leads frame.

Each modular section 28 comprises, as can be seen in FIGS. 3 and 5, essentially a top and bottom pair of spaced parallel side horizontal brace members 40 connected transversely therebetween by a top and bottom rear horizontal brace member 42, front vertical chord members 44, rear vertical chord member 46 and diagonal brace members 48. The shape of these individual members is, of course, optional, for example, they may have a square, rectangular or even channel-like cross section. It is only necessary that they be light in weight and relatively rigid. In addition, it should be noted that each modular section 28 might include a plurality of spaced side horizontal brace members 40, that is, at least three such members on a side, and an equal number of rear horizontal brace members 42. These would be connected by front and rear vertical chord members 44 and 46, respectively, and diagonal brace members 48 between successive horizontal members.

Figure 4:
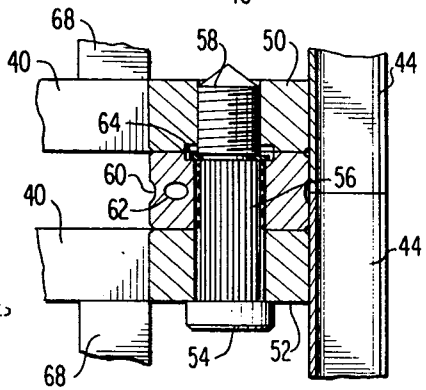
FIG. 4 is a cross-sectional view illustrating in greater detail one of the connecting joints between successive modular leads frames.

Turning now to FIGS. 3 and 4, the manner in which successive modular sections 28 are connected is readily apparent. Each of the rear vertical chord members 46 of the upper modular section 28 has an upper alignment block 50 inserted therein. This alignment block 50 is provided with a threaded bore preferably centrally therethrough. The block 50 is preferably welded in position within its respective rear vertical chord member 46, although other means of attaching the block 50 may be practiced. In like manner a lower alignment block 52 is preferably welded within a respective one of the rear vertical chord members 46 of the lower modular section 28 being connected. Each block 52 is provided with a through bore located generally centrally of the block 52. Passing through both blocks 50 and 52 is a bolt 54 which includes a splined section 56 and a threaded section 58. The threaded section 58 engages within the block 50. Interposed between each set of blocks 50 and 52 is a preferably hexagonal nut 60. The nut 60 also includes a central bore through which the bolt 54 passes. The nut 60 is also splined in its bore thereby providing an interlocking engagement between the nut 60 and its corresponding bolt 54. The nut 60 serves as a driving member for the bolt 54. To accomplish this purpose, the nut 60 is provided with hexagonal flat surfaces which provide engaging surfaces for effecting, with the aid of an appropriate tool, rotation of the nut 60 and thereby the bolt 54. The upper and lower flat surfaces of the nut 60 form bearing surfaces which bear against the opposed faces of the blocks 50 and 52 to effect thereby a perfect alignment when the bolt 54 is tightened. A snap-on lock washer 64 is also provided which holds the bolt 54 from falling away from the leads frame when not engaged.

At the front end of the modular sections the blocks 50 and 52 are preferably welded between the ends of the side horizontal brace members 40 and one side of their respective front vertical chord members 44. The joined assemblies including the bolt 54 for the front end of the joined modular sections 28 is otherwise similar to that described above with respect to the rear end of the joined modular sections. The nut 60 is different in that it is provided with a hole 62 through which a drift pin or bar is inserted for effecting rotation of the nut 60 and thereby the bolt 54. As can be seen the individual modular sections 28 can be added to or subtracted from the leads frame assembly 18 quite easily. It will become apparent from the discussion that follows that the shielding structure according to the present invention is not in any way adversely affected by the desire to add or subtract modular sections 28.

The front vertical chord members 44 form slotted guideways for the shield members according to the present invention. In addition, slotted guideways 66 and 68 are also provided. Two pairs of guideways 66 and 68 are contemplated, which are preferbly welded to the front alignment blocks 50 and 52. The slotted guideways 66 and 68 also define braking surfaces against which oppositely offstanding brake shoes carried by the driving hammer 24 can expand to thereby control the movement of the hammer.

Turning now to an initial consideration of the shield members according to the present invention, as illustrated most clearly in FIGS. 5 and 11, it is noted that each shield member is formed as a composite structure including a preferably fiberglass shell 70 to which a noise dampening fiber board 72 is preferably glued. Each shield member is preferably provided with a double-layered plastic window 74 which is conveniently constructed as a circular window for light transmission and observation. Further structural details are set forth hereinafter in conjunction with a consideration of FIG. 11.

A first set of shield members is defined as those shield members 30 which are mounted to the sides of the leads frame assembly 18. Preferably, the individual shield members 30 are form-fitted within the panel space defined, for the sides of the leads frame, by the side horizontal brace members 40, the rear vertical chord members 46, and the front vertical chord members 44; and, for the back of the leads frame, by the rear horizontal brace members 42 and the rear vertical chord members 46. The shield members 30 are preferably mounted within these panels by bolts 80 which are fastened to clip angles 82. Preferably, a bolt clip angle arrangement is provided at each of the four corners of the shield member 30. Also, the clip angles 82 are preferably welded to their respective vertical chord members.

A second set of shield members is defined as those shield members 32–36. To ensure a high degree of noise abatement it has been found desirable to surround the driving hammer 24 with a double layer of shield members. To effect this end, the arrangement shown most clearly in FIG. 5 is preferred. Other arrangements, of course, are also possible within the contemplation of the present invention.

To accomplish the desired end, the second set of shield members 32–36 is preferably formed as profiled members with a generally C-shaped cross section. As stated above, the shield members 32–36 are also constructed basically as a composite member including a preferably fiberglass shell 70 to which a dampening fiber board 72 is preferably glued. The windows 74 are preferably located on the back side of the shield member, as viewed in cross section. The free ends of the shield members 32–36 are formed as flange-like terminal ends 76 which are slidably received within a respective slotted vertical chord member or guide rail 44, 66 or 68. It should be noted that the guideway provided by front vertical chord members 44 is essentially a continuous guideway in a longitudinal direction of the leads frame assembly 18. The guideways provided by the slotted guide rails 68 are, however, not continuous as can be seen in FIGS. 3 and 4. However, the effect is unchanged since successive guide rails 68 form aligned guideways. Guide rails 66 may be arranged in their longitudinal direction similar to the vertical chord members 44 or the slotted guide rails 68.

The terminal ends 76 on one side of both the inner front shield member 34 and the rear shield member 36 have their external surface configured as shown in FIG. 6. At its top end there is formed a bore 98 within which a tapped sleeve 100 is, for example, molded in place. The sleeve 100 is threaded with tapered threads below the bore 98, the terminal end is provided with a cut-out portion 102 which may extend for any desired length toward the bottom end of the terminal end. The cut-out portion 102 has a recessed surface 104 within which a plurality of spaced holes 106 is formed. Bridging the cut-out portion 102 at the location of the holes 106 are generally L-shaped members 108 (FIG. 7) within which are provided holes 110. The holes 106 and 110 are is alignment. Adjacent each of the aligned holes 106, 110 are incined surfaces 112 and 114. An inclined surface 116 at the upper end of the top terminal end of the terminal end 76 is also provided. Finally, at the bottom end of the terminal end 76 there is formed a bore 118 within which a sleeve 120 is inserted. The sleeve 120 is preferably molded into the bore 118 and includes a tapped bore. The functional aspects of the various portions of the terminal end 76 described with references to FIGS. 6 and 7 will become clear from the description set forth hereinafter.

Figure 9:
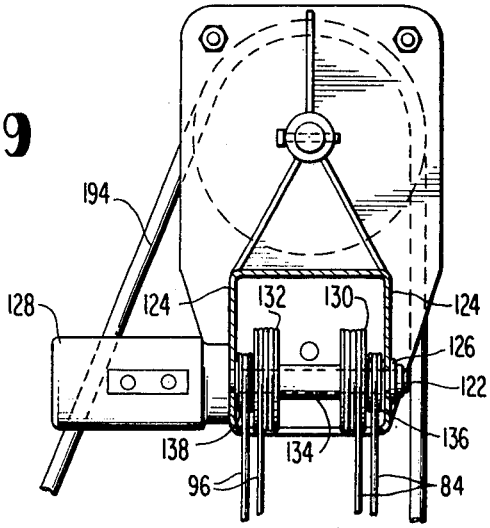
FIG. 9 is a view partly in cross section taken along the line 9—9 of FIG. 8.

To ensure abatement of the noise resulting from the impact of the driving hammer 24 against the pile 26 throughout the entire stroke of the driving hammer, the second set of shield members 32–36 is arranged to move with the driving hammer 24. The means for effecting the movement of the second set of shield members 32–36 will now be described with reference to FIGS. 8 and 9. A pair of endless cables 84 and 96 is provided for the inner front displaceable shield member 34 and the rear displaceable shield member 36, respectively. At the upper end of the leads frame assembly 18 a pair of spaced-apart shafts 122 is mounted between upstanding walls 124 of the leads frame assembly by bearings 126. One of the shafts 122 is driven by a torque motor 128 which, itself, is mounted to one of the upstanding walls 124. Mounted on each of the shafts 122 are spaced actuating drums 130 and 132 which are spaced apart by sleeve 134. Also mounted on each of the shafts 122 on the outside of the drums 130 and 132 are idler pulleys 136 and 138, respectively. The idler pulleys 136 and 138 rotate in an opposite direction to the actuating drums 130 and 132. The cable 84 has one end connected to a swivel connecting end 90 of a threaded tensioning rod 92 which is threadedly engaged within the bore of the sleeve 120 at the bottom of the inner front displaceable shield member 34. The cable 84 is then passed over a pulley 86, which is mounted to a clevis joint 88 and upwardly within the slotted guide rail 66 adjacent to the terminal end 76 of the inner front displaceable shield member 34 and over the idler pulley 136. From the idler pulley 136 the cable 84 proceeds across the leads frame assembly 18 to the corresponding idler pulley 136 on the other side of the leads frame assembly. The cable 84 is wrapped around this idler pulley and then proceeds down the opposite side of the leads frame assembly within the slotted guide bar 66 and passes through a clamp 140 which is preferably mounted to the inside surface of the slotted guide bar 66. After passing through the clamp 140, the cable 84 continues to pulley 86 and then proceeds upwardly through the guide bar 66 toward the drum 130 on the right side (FIG. 8) of the leads frame assembly 18. The cable 84 is then wrapped around the actuating drum 130 and from there proceeds once again across the leads frame assembly 18 to the drum 130 on the left side of the leads frame. The cable 84 is then wrapped around the actuating drum 130 on the left side of the leads frame and then proceeds from this drum down the guide bar 66 into the cut-out portion 102 and around a pin 94. The cable 84 is led into the cut-out portion 102 by the inclined surface 116. The pin 94 is mounted in one of the aligned holes 106, 110. From the pin 94 the cable 84 proceeds upwardly within the cut-out portion 102 and is deflected by a respective one of the slanted surfaces 114 so that the opposite end of the cable 84 can be anchored within the slotted nut 142, which, in turn, is provided with tapered threads and is threadedly engaged within the tapped sleeve 100 at the top of the terminal end 76 of the inner front displaceable shield member 34. The cable 96 travels a similar path with respect to pins, drums and idler pulleys in connecting the rear displaceable shield member 36 for upward and downward movement.

The cables 84 and 96, along with their associated displacement apparatus, form a first drive means which displaces the inner front and rear displaceable shield members 34 and 36 respectively relative to the leads frame assembly 18. This first drive means represents a closed system which permits the torque motor 128 to apply a force in either the clockwise or counterclockwise direction. This is thought desirable because of the possible drag of the shield member interlocks due to debris in the lower section thereof.

Returning once again to FIG. 6, it can be seen that the pin 94 can be inserted in either of the aligned holes 106, 110. In this way the first drive means is given an added capability which permits the cables 84 and 96 to be shortened or lengthened in order to accommodate the removal or addition, respectively, of other modular sections 28 to the leads frame assembly 18.

To raise and lower the outer front displaceable shield member 32, a second drive means is provided. The second drive means includes a worm gear double drum hoist 144, a pair of spaced-apart drums 146 and 148 which are mounted on a through shaft 150 which, in turn, is driven by the hoist 144. Each of the drums 146 and 148 is mounted to the shaft 150 by line bearings 152 and 154. The hoist 144 is mounted by a right angle bracket 156 to the upper end of the leads frame assembly 18. Wrapped around each of the drums 146 and 148 are cables 158. The free end of each of these cables 158 is connected to a swivel connecting end 160 from threaded rods which are, in turn, received within appropriate receptacles in the top end of the terminal ends 76 of the outer front displaceble shield member 32.

The second set of shield members 32–36 is preferably formed as single members which have a greater longitudinal extent than the fixed shield members 30. If desired, however; a second set of shield members 32–36 may also be formed as an assembly of shield members of lesser longitudinal extent which are connected together in any conventional manner.

Figure 10:
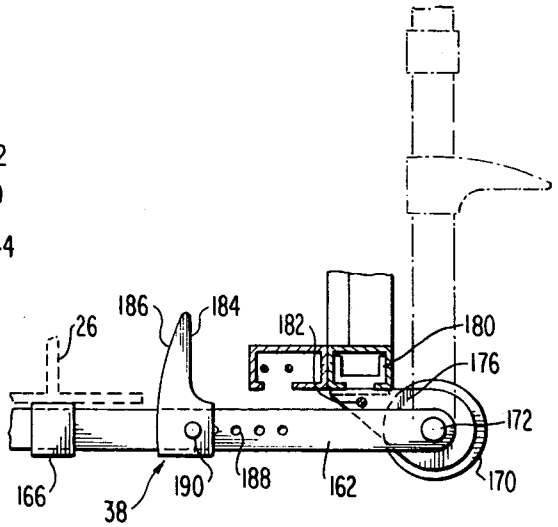
FIG. 10 is a partly cross-sectional view taken along the line 10—10 of FIG. 8 illustrating the two limiting positions of the pile feeder means.

When the hammer 24 and pile 26 are in position and driving is ready to commence, the actuator cylinder 170 is energized and the members 162 and 164 are rotated into an open position, that is, counterclockwise as viewed in FIG. 10. Then the hydraulic torque motor 128 is energized which causes the shield members 34 and 36 to be displaced downwardly relative to the shield member 32 while still retaining an overlapped relationship between these shield members (see FIGS. 1 and 2). In this way a good portion of the pile 26 is covered in the vicinity of the hammer 24. The hammer 24 is then started and thereafter the shields 32–36 are lowered to retain basically the overlapped relationship referred to above. Normally, the crane operator is signaled from a ground workman as to when the various shields 32 and 34, 36 should be moved.

Figure 8:
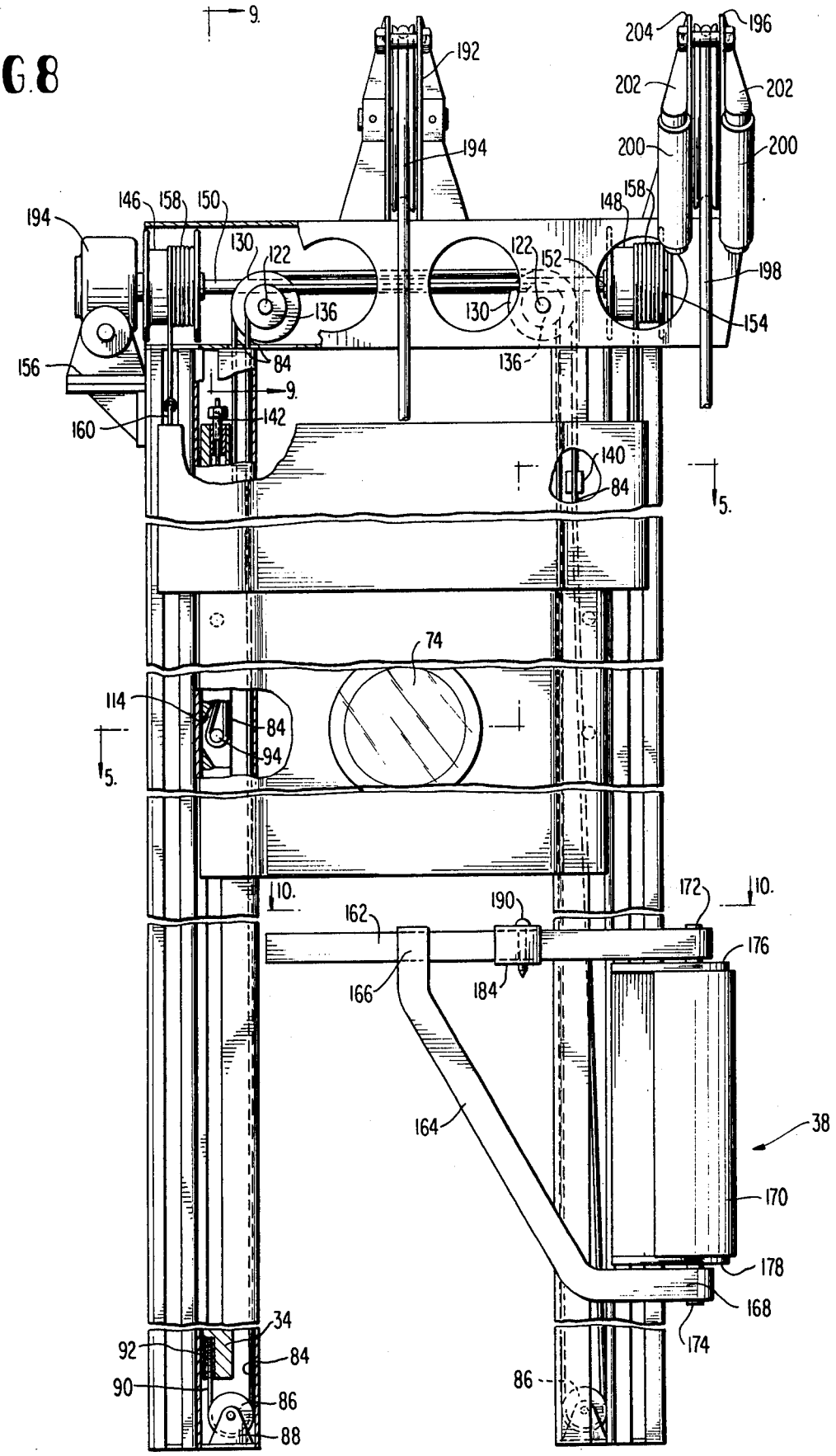
FIG. 8 is also a front elevational view emphasizing the details of the upper portion of the leads frame including the drive means for the displaceable shield members, the driving hammer hoist line, the pile hoist line and further details of the pile feeder, with also the structure removed and cross sectioning applied where necessary to facilitate illustration.

For a more specific understanding of the structure and operation of the pile feeder assembly 38, attention is directed to FIGS. 8 and 10. The pile feeder assembly 38 includes a bracket having a horizontal beam member 162 on which an angled brace member 164 is slidably mounted. For this purpose the brace member 164 has a vertically directed portion 166 which defines an opening through which the beam member 162 passes. The member 164 is also provided at its other end with a horizontal extension 168. The free end of the extension 168, as well as the corresponding end of the beam member 162, is provided with bores through which spline rods 172 and 174 of a helical rod-type rotary actuator cylinder 170 pass. These rod ends continue on and are mounted within the mounting sockets of an upper and lower mounting flange 176 and 178, respectively. Extending from each of the driving flanges 176 and 178 are interlocking shoe members 180. The shoe members 180 fit within either of the slotted front vertical chord members 44. At the outer end of the upper mounting flange 176 there is provided a cable bore 182 from which a cable extends upwardly to the bottom of the outer front displaceable shield member 32, an attachment on the shield member 32 being provided for this purpose. In this way, the pile feeder assembly 38 moves up and down together with the outer front displaceable shield member 32. The actuator cylinder 170 when energized causes the connected beam member 162 and angle member 164 to rotate through a maximum of 270° (FIG. 10).

Slidably mounted on the horizontal beam member 162 is a pile guide stop 184. The pile guide stop 184 is provided with an outwardly curved cam surface 186. The horizontal beam member 162 is also provided with a plurality of holes 188 which receive a pin 190 for mounting the guide stop 184 in a plurality of variable horizontal positons. In this way piles 26 of varying sizes can be accommodated by the pile driving machine.

At the top of the leads frame assembly 18 there is mounted a sheave 192 about which the cable 194 passes. The cable 194 has the drive hammer 24 connected thereto. The cable 194 is controlled to raise and lower the drive hammer 24 in a conventional manner.

Also mounted to the top of the leads frame assembly 18 is a sheave 196 about which a cable 198 passes. The cable 198 is utilized to raise and lower a pile 26 into position for being driven in conjunction with the pile feeder assembly 38. A pair of rollers 200 are mounted on brackets 202 to a supporting structure 204, which also serves as the support structure for the sheave 196. The rollers 200 serve to guide the cable 198 about the sheave 196.

In order to position a pile 26 to be driven by the drive hammer 24 according to the present invention, the following steps, not necessarily in the order given, may be followed: the cable 198 is fastened at ground level to one end of the pile 26 to be hoisted. The actuator cylinder 170 is then energized, causing the members 162 and 164 to be rotated into their open position (preferably through 270° as shown in FIG. 10). The drive hammer 24 is hoisted by the cable 194 in a conventional manner and the second set of shield members 32–36 is hoisted by the first and second drive means described above. The pile 26 is then hoisted by the cable 198 by conventional means (not shown) until it extends vertically. Of course, the height to which the drive hammer 24 and the second set of shield members 32–36 is raised depends upon the length of the pile to be driven. Once the pile is in its vertical position, the actuator cylinder 170 is once again energized thereby causing the members 162 and 164 to pivot back into their closed position. In the course of the return movement of the members 162 and 164, the pile 26 is engaged and caused to be moved into the leads frame assembly 18. The guide stop 186 has been so positioned by the pin 190 within a respective hole 188 so that the cam surface 186 engages the pile 26 and in the course of movement of the members 162 and 164 will cause the pile 26 when it is moved into the leads frame assembly 18 to be properly aligned so that the pile 26 can thereafter be properly driven by the drive hammer 24. As the pile 26 is being driven by the drive hammer 24, the second set of shield members 32–36 will be displaced with the displacement of the driven hammer 24 and the pile 26 so that the noise emanating from the impact of the drive hammer 24 against the pile 26 is effectively abated.

Turning now to FIG. 11, for a further consideration of the structure of both the shield members and the window, it is noted that the fiber board 72 consists preferably of a blanket of polyurethane foam with a lead foil lamination 72*a* embedded midway between its surfaces. The inside surface of the blanket is supplied with a pressure sensitive adhesive which adheres to the surface *a* of the fiberglass shell 70. The outside or exposed surface of the blanket is preferably provided with a thin sealing skin 72*b* that will prevent moisture, oil and dirt absorption. In manufacture the surface *a* is initially sandblasted and thereafter the fiber board 72 adhered thereto. Also, the second set of shield members 32–36 is preferably fabricated as cast members.

The windows 74 include a male section 74*a* and a female section 74*b* and flanged glue surfaces *b, c* and *d.* To assemble the windows, the assembled shield members are knifed out or cut at the desired window location. Thereafter the male section 74*a* is connected preferably by any member of screws 206 to the exposed surface of the fiberglass shell 70. Preferably the flange surface *b* is provided with glue. The female section 74*b* has glue applied to its flange surfaces *c* and *d* and thereafter it is pressed in place from the fiber board side of the shield member. Clamps (not shown) are then applied to hold the different sections in assembly until the glue dries. The assembled male and female sections of the window define a dead air space 74*c.*

That which is claimed is:

1. A method of abating noise in a pile driving machine when operating to drive a pile, the machine including a boom, a leads frame operatively associated therewith and a pile driving hammer, with the leads frame extending substantially the full length of the undriven pile, the method comprising the steps of:

a. fixedly mounting a first set of noise abating means to the leads frame, along the full extent thereof;

b. mounting a second set of noise abating means to the leads frame in approximate location with the driving hammer for displacement along the leads frame with the driving hammer;

c. moving certain ones of the second set of noise abating means relative to other ones thereof to establish an overlapping relationship therebetween; and d. moving the overlapped second set of noise abating means with the driving hammer throughout its driving range.

2. A method of abating noise in a pile driving machine as defined in claim 1, further comprising the step of surrounding the driving hammer with both sets of the noise abating means, such that the driving hammer is surrounded by two layers of noise abating means throughout its driving range.

* * * * *